US007470375B2

(12) United States Patent
Koyama et al.

(10) Patent No.: US 7,470,375 B2
(45) Date of Patent: Dec. 30, 2008

(54) METHOD FOR MANUFACTURING LIQUID EJECTION HEAD, SUBSTRATE FOR LIQUID EJECTION HEAD, AND LIQUID EJECTION HEAD

(75) Inventors: Shuji Koyama, Kawasaki (JP); Shingo Nagata, Machida (JP); Kenji Fujii, Haratsuka (JP); Jun Yamamuro, Hiratsuka (JP); Masaki Osumi, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 492 days.

(21) Appl. No.: 11/255,679

(22) Filed: Oct. 20, 2005

(65) Prior Publication Data

US 2006/0090338 A1 May 4, 2006

(30) Foreign Application Priority Data

Oct. 22, 2004 (JP) ..... 2004-307527

(51) Int. Cl.
*B41J 2/16* (2006.01)

(52) U.S. Cl. ..... 216/27

(58) Field of Classification Search ..... None
See application file for complete search history.

(56) References Cited

U.S. PATENT DOCUMENTS

| | | | | |
|---|---|---|---|---|
| 4,789,425 | A * | 12/1988 | Drake et al. | 216/27 |
| 6,450,621 | B1 * | 9/2002 | Hayakawa | 347/63 |
| 6,858,152 | B2 | 2/2005 | Koyama | |
| 6,883,901 | B2 * | 4/2005 | Murai et al. | 347/68 |
| 6,908,564 | B2 * | 6/2005 | Koyama et al. | 216/27 |
| 7,001,010 | B2 * | 2/2006 | Koyama et al. | 347/47 |
| 7,255,418 | B2 * | 8/2007 | Koyama et al. | 347/20 |
| 7,287,847 | B2 * | 10/2007 | Fujii et al. | 347/93 |
| 2003/0038108 | A1 * | 2/2003 | Koyama et al. | 216/27 |
| 2005/0088478 | A1 * | 4/2005 | Koyama et al. | 347/20 |
| 2006/0085981 | A1 * | 4/2006 | Koyama et al. | 29/890.1 |

* cited by examiner

*Primary Examiner*—Allan Olsen
(74) *Attorney, Agent, or Firm*—Canon USA Inc IP DIV

(57) ABSTRACT

A method for precisely manufacturing a liquid supply orifice of an ink-jet recording head, even if a masking material includes pinholes which may affect the forming of the ink supply orifice, is provided. The substrate face provided with a mask used for forming the ink supply orifice has an area covered with the mask for anisotropic etching, the area consisting of a part provided with OSF layers and a part not provided with the OSF layers which are determined by considering the amount of a side etching.

7 Claims, 4 Drawing Sheets

METHOD FOR MANUFACTURING LIQUID EJECTION HEAD, SUBSTRATE FOR LIQUID EJECTION HEAD, AND LIQUID EJECTION HEAD

BACKGROUND OF THE INVENTION

1. Field of the Invention

The present invention relates to methods for manufacturing liquid ejection heads, substrates for liquid ejection heads, and liquid ejection heads. Specifically, the present invention relates to methods for manufacturing ink-jet recording heads, which conduct recording by forming flying droplets by ejection of ink, by forming ink supply orifices for receiving ink into the ink-jet recording heads by anisotropic etching of silicon (Si), substrates for ink-jet recording heads, and ink-jet recording heads.

2. Description of the Related Art

Ink-jet recording apparatuses conducting recording by ejecting ink and adhering the ink to recording media are used in various types of office equipment such as printers, copiers, and facsimile machines. Generally, the ink-jet recording apparatuses each include an ink-jet recording head and an ink supply system for supplying ink to the head.

The ink-jet recording head is generally provided with ink ejection-energy-generating elements for generating energy for ejecting ink, ink ejection openings for ejecting ink, an ink channel communicating with each of the ink ejection openings, and an ink supply orifice for receiving ink from the ink supply system. Some of the ink-jet recording heads are a side-shooter type, i.e. ink droplets are ejected in the direction perpendicular to a substrate face on which the ink ejection-energy-generating elements are formed. In the side-shooter type ink-jet recording head, the ink supply orifice (liquid supply orifice) is generally formed as a through-hole in the substrate of silicon or the like (referred to as Si substrate, hereinafter).

The ink supply orifice of the through-hole can be formed by anisotropic etching of the Si substrate. Furthermore, U.S. Pat. No. 6,858,152 discloses a method for decreasing variation in formation width of the ink supply orifice caused by defects locally existing in the Si substrate. In the method, oxidation-induced stacking faults (OSFs) at an interface between the Si substrate to be etched and a $SiO_2$ film used as a mask are formed. The density and thickness of the OSF regulate a side-etching rate, so that the effects of the defect in the substrate are decreased to reduce the variation in the formation width of the ink supply orifice; thus, yield ratios in manufacturing are improved.

In some ink-jet recording heads for color printing, a plurality of ink supply orifices are provided on a single silicon substrate in parallel to each other, and different inks are supplied from the respective ink supply orifices to eject inks of different colors. The ink-jet recording head having such a structure is required to minimize the substrate size of the recording head in order to achieve downsizing of the ink-jet recording head itself and to reduce a manufacturing cost of the ink-jet recording head. Therefore, a shorter distance between adjacent ink supply orifices is desirable.

However, it was found that the formation width of the ink supply orifices varies when the ink supply orifices are formed at an extremely short distance from each other by the method disclosed in U.S. Pat. No. 6,858,152. The present inventors have intensively studied and have found a new technological issue that just a little defect such as a pinhole in a masking material may affect the formation width of the ink supply orifices depending on the position of the defect.

SUMMARY OF THE INVENTION

The present invention is directed to a method for manufacturing a liquid ejection head, a substrate for a liquid ejection head, and a liquid ejection head using the substrate. A liquid supply orifice of a liquid ejection head can be precisely formed by the method even if a masking material includes pinholes which may affect the forming of the liquid supply orifice.

In one aspect of the present invention, a method for manufacturing a liquid ejection head including a substrate provided with ejection-energy-generating elements operable to generate energy for ejecting liquid and provided with a liquid supply orifice adapted to supply liquid to the ejection-energy-generating elements is provided. The method includes a step of preparing a Si substrate having a first face used to form the ejection-energy-generating elements and a second face; a step of forming a mask used for forming the liquid supply orifice on the second face of the Si substrate; a step of forming oxidation-induced stacking faults in the second face of the Si substrate only at a portion in which the periphery of the portion corresponds to an opening of the mask; a step of forming the ejection-energy-generating elements on the first face of the Si substrate; and a step of forming the liquid supply orifice passing through the substrate by anisotropic etching using the mask.

In another aspect of the present invention, a substrate of silicon used for manufacturing a liquid ejection head is provided. The substrate includes ejection-energy-generating elements, provided on one a first face of the substrate, are configured to generate energy for ejecting liquid; semiconductor elements, provided on the first face of the substrate, are configured to drive the ejection-energy-generating elements; and a mask, provided on the second face, adapted for forming a liquid supply orifice for configured to supply liquid to the energy-generating elements, wherein the second face is provided with oxidation-induced stacking faults having a thickness of about 2 μm or more with a density of about $2\times10^4$ stacking faults/$cm^2$ or more only at a portion in which the periphery of the portion corresponds to the opening of the mask.

In another aspect of the present invention, a liquid ejection head according to the present invention is manufactured by the above-mentioned method for manufacturing a liquid ejection head and includes a plurality of liquid supply orifices.

According to the present invention, the method for manufacturing the liquid ejection head includes a step of forming the liquid supply orifice by anisotropic etching of Si and forms OSFs in the rear face of the substrate only at portions receiving the anisotropic etching. This prevents abnormal etching caused by pinholes or defects of the masking material, and stably provides the liquid supply orifice having a predetermined uniform opening width at the front face of the substrate.

Therefore, a yield ratio in manufacturing the liquid ejection head can be increased, and reliability in ejection performance of the liquid ejection head can be improved. Furthermore, the distance between the liquid supply orifice and the ejection-energy-generating elements can be decreased, and the liquid ejection head having a high frequency of ejection can be manufactured at a high yield ratio.

Further features of the present invention will become apparent from the following description of exemplary embodiments with reference to the attached drawings.

DESCRIPTION OF THE EMBODIMENTS

The embodiments according to the present invention will now be described with reference to the drawings.

Figure 1A:
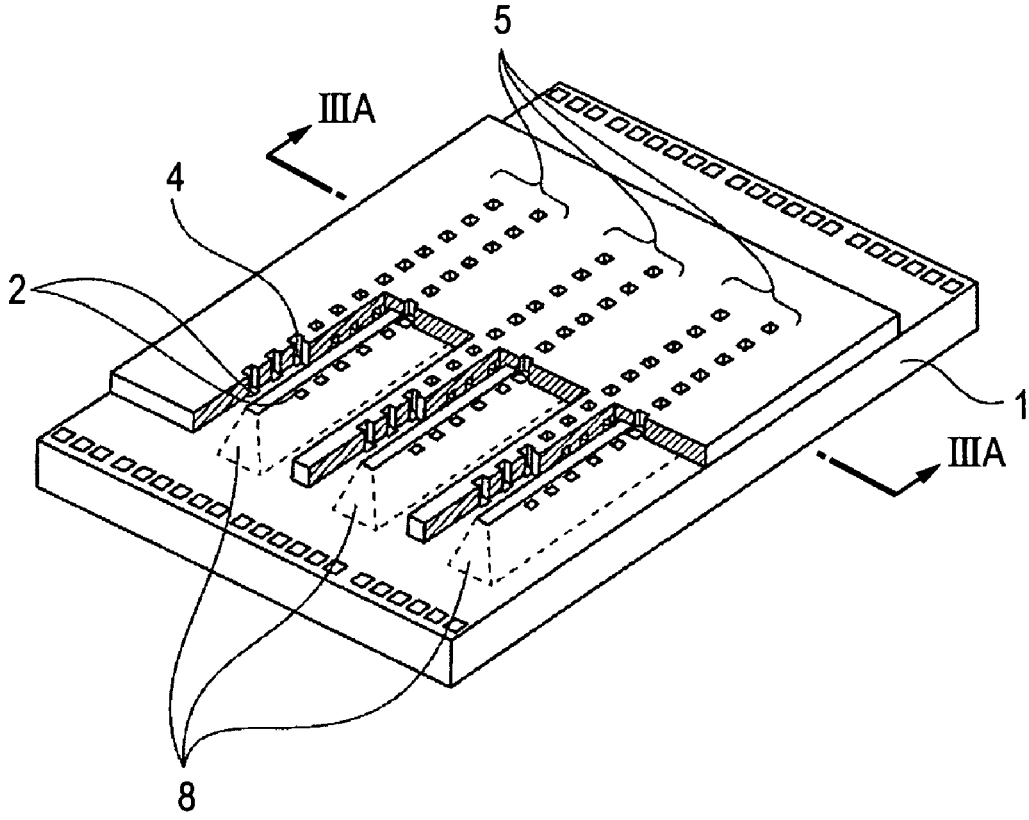
FIGS. 1A and 1B are perspective views, partially broken away, of ink-jet recording heads to which the present invention can be applied.
Figure 1B:
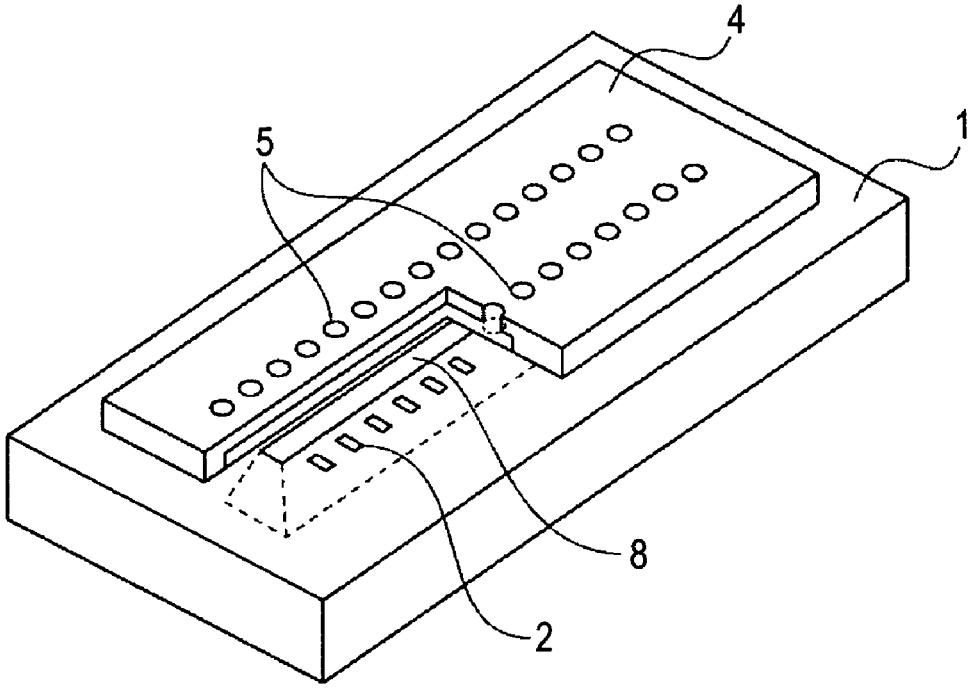
Figure 2:
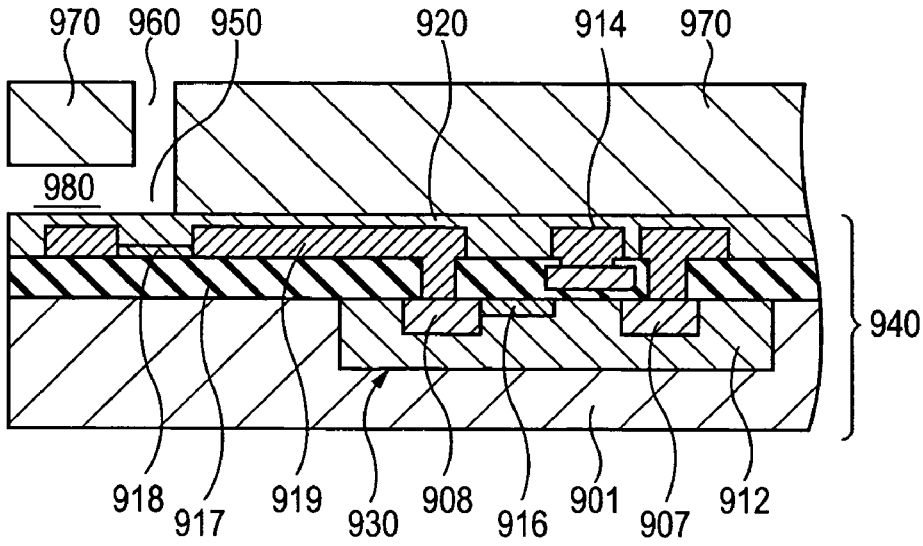
FIG. 2 is a schematic cross-sectional view of a part of a recording head to which the present invention can be applied.

With reference to FIG. 1 and FIG. 2, ink-jet recording heads to which the present invention can be applied will be described. FIGS. 1A and 1B are perspective views, partially broken away, of ink-jet recording heads to which the present invention can be applied. FIG. 2 is a schematic cross-sectional view of a part of a recording head to which the present invention can be applied.

As shown in FIGS. 1A and 1B, the ink-jet recording head (liquid ejection head) to which the present invention can be applied includes a Si substrate 1 provided with ink ejection-energy-generating elements (liquid ejection-energy-generating element) 2 at a prescribed interval in two lines facing each other. The Si substrate 1 includes an ink supply orifice (liquid supply orifice) 8 between the two lines of the ink ejection-energy-generating elements 2. The ink supply orifice 8 is formed by anisotropic etching of Si using a mask of $SiO_2$ film 6, as described below. An orifice plate 4 is disposed on the Si substrate 1. The orifice plate 4 provides ink ejection openings (liquid ejection openings) 5 above the ink ejection-energy-generating elements 2 and an ink channel (liquid channel) connecting the ink supply orifice 8 to the ink ejection openings 5. The ink-jet recording head conducts recording by applying pressure generated by the ink ejection-energy-generating elements 2 to ink in the ink channel through the ink supply orifice 8 so that the ink droplets are ejected from the ink ejection openings 5 to be adhered to a recording medium.

The substrate of the recording head according to this embodiment is provided with the ink ejection-energy-generating elements. Each ink ejection-energy-generating element includes an electro-thermal transducing element, an element for switching the electro-thermal transducing element (referred to as switching element, hereinafter), and a circuit for driving the switching element. FIG. 2 is a schematic cross-sectional view of a part of the recording head of this embodiment: wherein reference number 901 denotes a semiconductor base material of monocrystal silicon, reference number 912 denotes a p-type well region, reference number 908 denotes an n-type drain region containing an impurity at a high concentration, reference number 916 denotes an n-type electric-field moderating drain region containing an impurity at a low concentration, reference number 907 denotes an n-type source region containing an impurity at a high concentration, reference number 914 denotes a gate electrode, and these form the switch element 930 using an MIS-type field-effect transistor. Reference number 917 denotes a silicon oxide layer as a heat storage layer and an insulating layer, reference number 918 denotes a tantalum nitride film as a heat-resistive layer, reference number 919 denotes an aluminum alloy film as wiring, and reference number 920 denotes a silicon nitride film as a protection layer, and these form a base material 940 of the recording head. Heat is generated at a portion denoted by reference number 950, and ink is ejected from a portion denoted by reference number 960. A top panel 970 forms a liquid channel 980 in cooperation with the base material 940.

The ink-jet recording head shown in FIG. 1A is provided with a plurality of ejection openings each corresponding to the respective ink supply orifices, so that each of the ejection openings can eject different inks respectively. The present invention particularly achieves desired effects in a recording head having a configuration shown in FIG. 1A, but the present invention can also be applied to a recording head having a single ink supply orifice as shown in FIG. 1B.

Figure 3A:
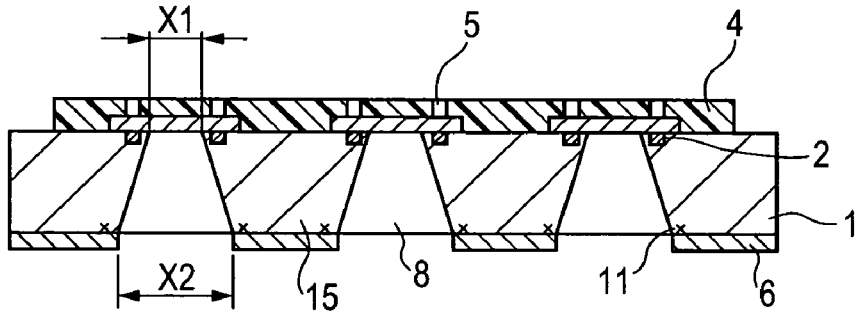
FIGS. 3A and 3B are schematic explanatory views of an ink-jet recording head according to the present invention.
Figure 3B:
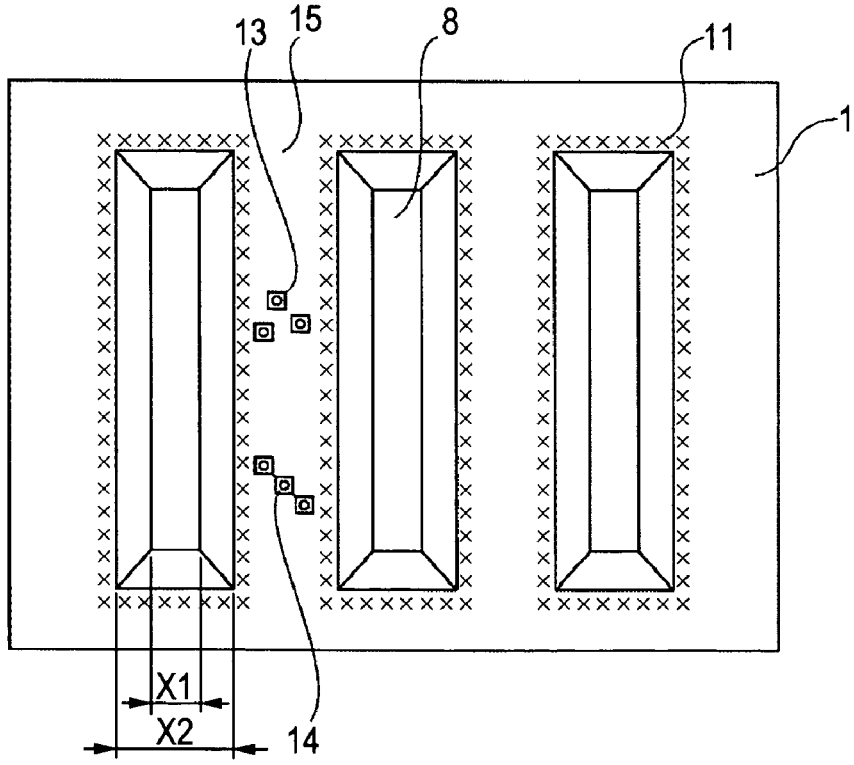

A method for manufacturing the ink-jet recording head will now be described with reference to FIG. 3 and FIG. 4. FIGS. 3A and 3B are schematic explanatory views of the ink-jet recording head according to the present invention. FIG. 3A is a cross-sectional view of the ink-jet recording head according to the present invention taken along the IIIA-IIIA line in FIG. 1A, and FIG. 3B is a rear view of the ink-jet recording head shown in FIG. 1A. FIGS. 4A to 4F are schematic cross-sectional views of the ink-jet recording head in each manufacturing process.

The embodiment is a method for manufacturing the ink-jet recording head using heat-generating resistive elements as the ink ejection-energy-generating elements 2, the so-called Bubblejet (registered trademark) recording system. However, a liquid ejection system of the ink-jet recording head to which the present invention can be applied is not limited to that using the heat-generating resistive elements and may be those using piezo elements.

Figure 4A:
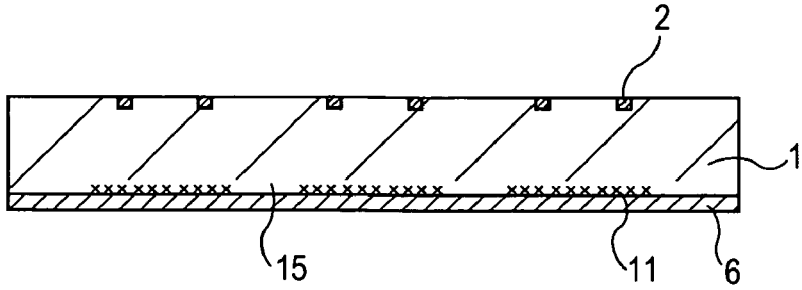
FIGS. 4A to 4F are schematic cross-sectional views of the ink-jet recording head in each manufacturing process.

The ink ejection-energy-generating elements 2 of this embodiment are formed in a face (a first face) of Si substrate 1 having a crystal face orientation of <100>. The Si substrate 1 may have a crystal face orientation of <110>. As shown in FIG. 4A, the ink ejection-energy-generating elements 2 and driving circuits (not shown) having semiconductor elements for driving the ink ejection-energy-generating elements 2 are formed on the Si substrate 1 by a known semiconductor manufacturing technology. After the formation of the driving circuits, extraction electrodes (not shown) for connecting the ink ejection-energy-generating elements 2 to control equipment disposed outside the ink-jet recording head are formed.

An oxide film, $SiO_2$ film 6, is formed on the other side of the Si substrate 1, i.e. on the rear face (a second face), where the ink ejection-energy-generating elements 2 are not formed. The $SiO_2$ film 6 is a thermally oxidized film and is used for separating elements when the semiconductor elements are formed on the Si substrate 1. The $SiO_2$ film 6 is left on the rear face of the Si substrate 1 to be used as an etching mask when the ink supply orifice 8 is formed in a later process. The thickness of the $SiO_2$ film 6 is preferably 0.7 μm or more.

As shown in FIG. 4A, OSFs 11 are formed in the rear face of the Si substrate 1 at portions and the peripheries of the portions where the ink supply orifice is formed. The portions where the OSFs are not formed are denoted as regions 15. The partial formation of the OSFs can be performed by a mechanically damaging process, or a physical or chemical etching process. The details of the processes will be described in the Embodiments.

Figure 4B:
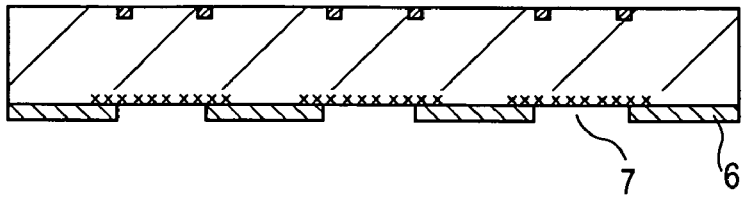

As shown in FIG. 4B, apertures 7 for etching are patterned in the $SiO_2$ film 6 formed on the rear face of the Si substrate 1 by photolithography.

Figure 4C:
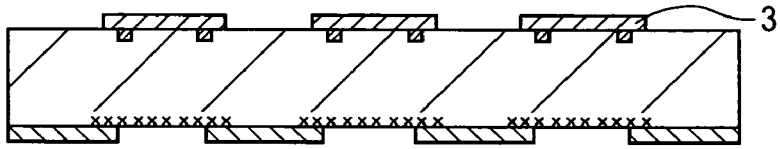

As shown in FIG. 4C, section bars 3 are formed on the front face, which is the side the ink ejection-energy-generating elements 2 are formed, of the Si substrate 1. The section bars 3 are melted and eluted out in a later process to form ink channels at the portions where the section bars 3 are disposed. The section bars 3 are formed to have a proper height and a flat pattern so that the ink channels can have a desired height and a flat pattern. The formation of the section bars 3 are conducted, for example, as follows:

The section bars 3 are formed by applying a material, for example, positive type photoresist ODUR 1010 (manufactured by Tokyo Ohka Kogyo Co., Ltd.), on the Si substrate 1 by dry-film lamination, spin coating, or the like at a predetermined thickness. Then, a patterning process of photolithography is performed by exposure to ultraviolet or deep UV radiation and by development. Thus, the section bars 3 having a desired thickness and flat pattern are formed.

Figure 4D:
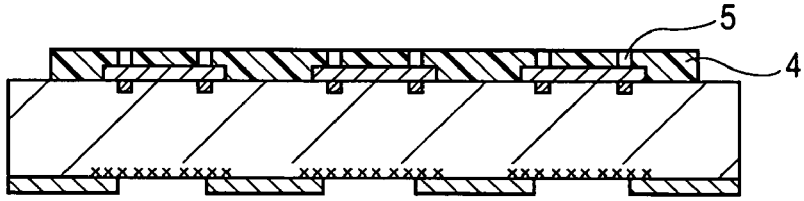

As shown in FIG. 4D, a material for the orifice plate 4 is applied on the Si substrate 1 by spin coating or the like so as to cover the section bars 3 formed in the foregoing process, and the orifice plate 4 is patterned into a predetermined shape by photolithography. Then, the ink ejection openings 5 are formed in the orifice plate 4 at the positions corresponding to the ink ejection-energy-generating elements 2 by photolithography. The orifice plate 4 is laminated with a water repellent layer (not shown) such as a dry film on the face where the ink ejection openings 5 are formed.

Examples of the material for the orifice plate 4 include a photosensitive epoxy resin and a photosensitive acryl resin. The orifice plate 4 constitutes ink channels and is in constant contact with ink when the ink-jet recording head is used. Therefore, photoinitiated cationic polymers are suitable as the material of the orifice plate 4. Furthermore, since the durability of the orifice plate 4 depends on the type and properties of ink, proper compounds in addition to the above-mentioned materials may be used as the orifice plate 4 depending on the ink to be used.

Figure 4E:
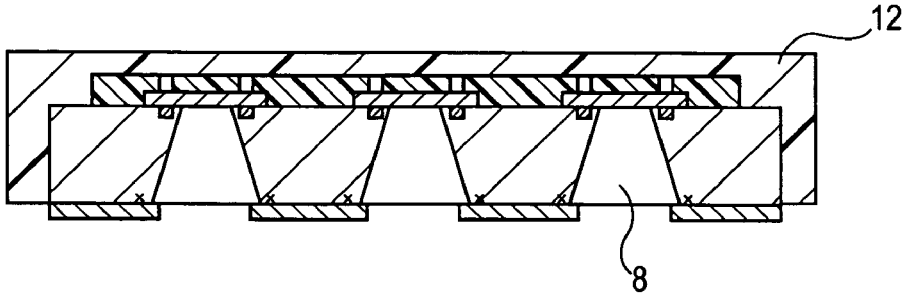

As shown in FIG. 4E, the ink supply orifices 8, i.e. through-holes passing through the Si substrate 1, are formed by anisotropic etching using the $SiO_2$ film 6 as a mask. Before the etching process, a protective member 12 of resin is formed by spin coating so as to cover the face of the ink-jet recording head where the function elements are formed and to cover the side faces of the Si substrate 1. So, these faces are not in contact with the etching solution. The protective member 12 is formed with a material sufficiently durable to a strong alkaline solution used in the anisotropic etching. With such a protective member 12 covering the orifice plate 4, the degradation of the water repellent layer is also protected.

The etching solution used in the anisotropic etching is a strong alkaline solution such as a tetramethylammonium hydroxide (TMAH) solution. For example, the through-holes are formed by applying a 22 wt % TMAH solution to the Si substrate 1 from the apertures 7 for etching at 80° C. for a predetermined period of time (ten and several hours). The mask used in the etching process is not limited to the $SiO_2$ film, and any material durable to the strong alkaline solution can be used.

Figure 4F:
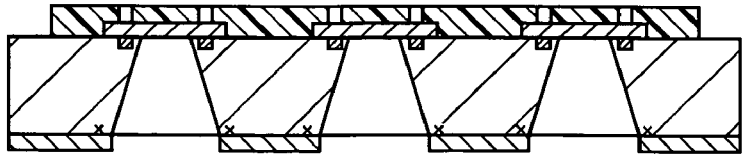

As shown in FIG. 4F, the $SiO_2$ film patterning mask 6 and the protective member 12 are removed. Furthermore, the section bars 3 are melted and are eluted out through the ink ejection openings 5 and the ink supply orifices 8. Then, the ink ejection openings 5 and the ink supply orifices 8 are dried. The elution of the section bars 3 can be performed by entire exposure to deep UV radiation and then by development. Substantially complete removal of the section bars 3 can be performed by ultrasound immersion during the development, if necessary.

With that, the main manufacturing processes of the ink-jet recording head are accomplished. A chip formed in such a manner is provided with a connection for driving the ink ejection-energy-generating elements 2 and a chip tank for supplying ink, if necessary. One ink-jet recording head is shown in FIG. 4, but a plurality of the ink-jet recording heads can be formed on a single substrate by a semiconductor manufacturing technology generally used. In such a method, elements (i.e. ink-jet recording heads) having the same configuration are formed to be arranged in parallel on the single substrate. The elements arranged on the substrate are divided into individual chips by die sawing or the like.

In the method for manufacturing the ink-jet recording head mentioned above, as shown in FIG. 3A, ink supply orifice walls 9 (face orientation of <111>) are formed to make an angle of about 54.7° to the rear face of the Si substrate 1 at the openings of the ink supply orifices 8 by performing anisotropic etching from the rear face having a crystal orientation of <100>. Therefore, when the anisotropic etching is performed, the ink supply orifices 8 having a predetermined width (X1) at the front face of the Si substrate 1 where the ink ejection-energy-generating elements 2 are disposed can be provided by forming the apertures 7 in the $SiO_2$ film 6 on the rear face of the Si substrate 1 so as to have a predetermined width (X2). Namely, when the thickness of the Si substrate 1 is t, the relations can be expressed by the following formula:

$$X1 = X2 - 2t/\tan 54.7°$$

According to the present invention, OSF layers 11 are formed in the rear face of the Si substrate 1 where the $SiO_2$ film 6 is disposed as a mask for forming the ink supply orifices 8. The portions of the rear face covered with the mask during the anisotropic etching have regions provided with the OSF layers 11 and regions 15 not provided with the OSF layers, and these regions are determined by considering the amount of the side etching.

Figure 6A:
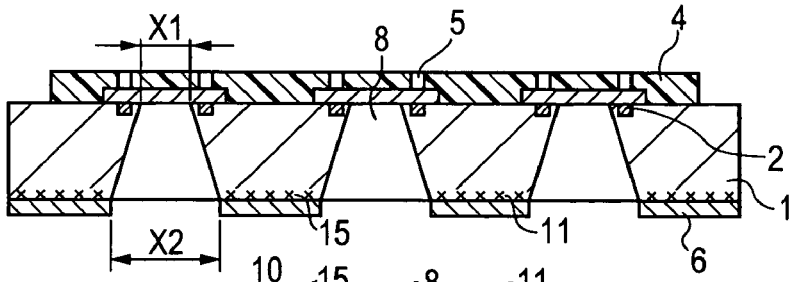
FIGS. 6A and 6B are schematic explanatory views of ink supply orifice portions of the ink-jet recording head, showing the state of ink supply orifices when abnormal etching occurred.
Figure 6B:
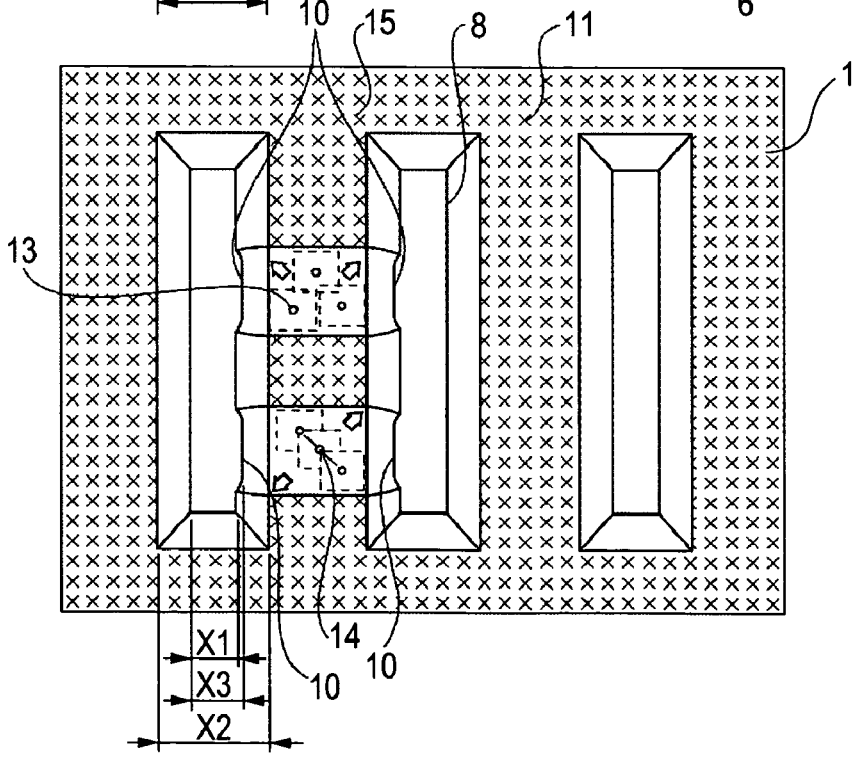

As shown in FIG. 6, if the OSF layers are formed in the whole face covered with the mask, patterns etched from pinholes overlap and etching progresses in the directions shown by arrows when the mask of the $SiO_2$ film 6 has pinholes 13. When many such defects exist near ink supply orifices 8, abnormal etching 10 occurs. As a result, the formation width of the ink supply orifices 8 may largely vary.

However, according to the present invention, the OSF layers are provided only at necessary portions (i.e. portions where side etching is performed when the ink supply orifices 8 are formed). Therefore, even if pinholes are generated in the mask between the ink supply orifices 8, abnormal etching can be substantially prevented because the etching rate at that portion is low.

Since the OSF layers are provided at the necessary portions, internal defects can be reduced by increasing a side-etching rate, compared with those when the OSF layers are not formed.

As described above, according to the present invention, the opening width of the ink supply orifices 8 at the surface of the Si substrate 1 can be precisely regulated with high accuracy by precisely forming the opening width for etching. Therefore, the distance from the opening of the ink supply orifice 8 to the ink ejection-energy-generating elements 2 can be precisely regulated with high accuracy.

In the above description, the ink channel is formed before the formation of the ink supply orifices, but the manufacturing processes according to the present invention are not limited to such a procedure. For example, a Si substrate including the ejection-energy-generating elements and the semiconductor elements at one side, the mask for forming the ink supply orifices at the other side, and OSFs having a thickness of about 2 μm or more at portions and the peripheries of the portions corresponding to the openings of the mask with a density of $2\times10^4$ stacking faults/$cm^2$ or more is prepared. Then, after the forming of the ink supply orifice in the Si substrate, an ink channel is attached to the Si substrate.

First Embodiment

The inventors have found that if the rear face has defects the etching rate becomes high, and if the many defects overlap abnormal etching occurs, and the opening widths are unstably formed.

The inventors have thought that the opening widths may be stably formed even if the rear face of the Si substrate 1 has defects such as pinholes when the side etching rate is decreased by increasing the OSF density in the rear face at portions and the peripheries of the portions where the ink supply orifices are formed and not forming the OSF at the other portion of the rear face. The crystal defects can be absorbed and the effects of the crystal defects can be decreased by a rapid side etching which can be achieved by increasing the etching rate by increasing the thickness (length in the direction of thickness of the substrate) of the OSF at portions and the peripheries of the portions where the ink supply orifices are formed.

In such a case, the amount of the side etching at the portions where the ink supply orifices are formed is increased. The side etching can be uniformly controlled at a predetermined amount by properly regulating the thickness and the density of the OSF in the rear face of the Si substrate 1. Therefore, it is thought that variation in the opening width of the ink supply orifices 8 at the front side caused by variation in the above-mentioned side etching amount can be also reduced.

Even if the defects such as pinholes are formed at the portions where the ink supply orifices are not disposed, the defects do not overlap and the Si substrate 1 is not highly etched because the side etching rate is low.

Figure 5:
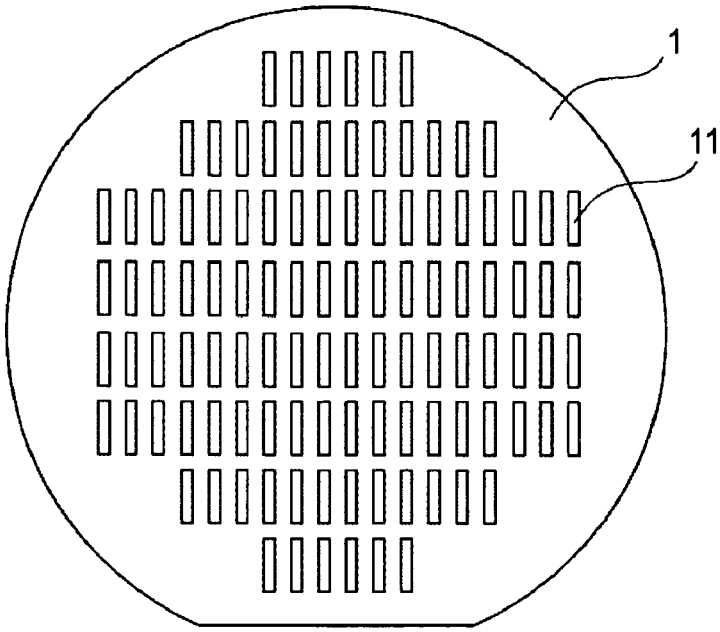
FIG. 5 is a schematic view of the rear face of a substrate for the ink-jet recording head of the present invention.

Here, an actual example that the ink supply orifices 8 are formed by anisotropic etching, the OSFs are formed in the rear face of the Si substrate 1 at portions and the peripheries of the portions where the ink supply orifices 8 are disposed, and the OSFs are not formed at another portions will now be described. The OSF is generated by various causes. One of the causes is a method for forming backside damage at portions where the OSF is formed by sandblasting. FIG. 5 shows the Si substrate 1 and the rear face provided with the OSF layers 11. The backside damage is formed by sandblasting at portions where the OSFs are formed. A resist is applied at a portion where the ink supply orifices 8 are not formed, and then the sandblasting is performed to form the backside damage at the portions where the resist is not applied. Then, the Si substrate 1 is thermally oxidized to form a $SiO_2$ film. As a result, OSFs are formed. By anisotropic etching of such a formed substrate, the side etching rate is about 3 to 4 μm/hr even if pinholes 13 of the mask or pinholes 14 caused by defects are generated, as shown in FIG. 3. Therefore, even if the anisotropic etching is performed for 17 hours, the side etching progresses only 51 to 68 μm to decrease the rate of the overlapping of pinholes. Thus, the Si substrate is not largely etched and the opening width X1 can be stably obtained.

Furthermore, since OSFs are formed at an interface between the Si substrate provided with ink supply orifice and the $SiO_2$ film, the opening width is uniform without the effect of the defects inside the Si substrate. The $SiO_2$ film is not shown in FIG. 3B in order to clarify the drawing.

In this example, the OSF density is $2\times10^4$ stacking faults/$cm^2$ or more, and the thickness of the OSF is 2 μm or more. Variation in the opening width at the front side of the ink supply orifices 8 is regulated at 30 μm or less.

Second Embodiment

The inventors tried to form the OSF partially by a method other than sandblasting. The method will now be described.

In the First Embodiment, the mechanical damaged layer is formed by patterning a resist on the rear face of the Si substrate by photolithography so that the resist has openings (where the resist is not formed) for forming OSF, and by applying backside damage to the substrate by sandblasting. In this Embodiment, the mechanical damage layer is formed by other method.

At first, the rear face of the substrate is patterned by photolithography so that the resist is formed at regions where the OSF is not formed and an opening (a region where the resist is not formed) is formed at a region where the OSF is formed, as in First Embodiment.

Then, the surface of the silicon is etched by reactive ion etching (RIE) or chemical dry etching (CDE). In the RIE process, chlorine or fluorine based etching gas is used. In the CDE process, fluorine based etching gas is used.

By etching of the Si surface, a damage layer is formed as in sandblasting, and OSF can be formed by thermal-oxidation in a later process.

Further, it was confirmed that the OSF can be formed by a combination of sandblasting and dry etching.

The results of anisotropic etching of the substrate are similar to those in First Example, namely, the rate that pinholes overlap is reduced, the Si substrate is not largely etched, and the opening width X1 can be stably prepared.

Since the OSF is provided at the interface between the Si substrate where the ink supply orifice is formed and the $SiO_2$ film, the opening width is stably formed without receiving influence of defects inside the Si substrate.

In this case, the OSF density is $2\times10^4$ stacking faults/$cm^2$ or more, the thickness of the OSF is 2 μm or more, and variation in the opening width of the ink supply orifice 8 at the front face is regulated at 30 μm or less.

As described above, when the ink supply orifice 8 is formed according to this Embodiment, it is observed that variation in the opening width of the ink supply orifice 8 at the front face can be regulated within a small range by controlling the OSF density of a portion in the rear face of the Si substrate 1 where the ink supply orifice 8 is formed to $2\times10^4$ stacking faults/$cm^2$ or more and the thickness of the OSF to 2 μm or more, and by not forming the OSF at a portion where the ink supply orifice 8 is not formed.

By controlling the variation in the opening width of the ink supply orifice 8 at the front face within a small range, the distance between the ink supply orifice 8 and the ink ejection-energy-generating elements 2 can be precisely regulated and the ink-jet recording head which can conduct recording with good reliability and high quality can be manufactured. Furthermore, by controlling the variation in the opening width of the ink supply orifice 8 at the front face within a small range, the driving circuits can be prevented from adverse effects caused by that part of the opening of the ink supply orifice 8 at the front face reaching near the ink ejection-energy-generating elements 2. As a result, the distance between the ink supply orifice 8 and the ink ejection-energy-generating elements 2 can be decreased, and yield ratios in manufacturing the ink-jet recording head having a high frequency of the ink ejection are improved.

In each Embodiment, a Si substrate having an oxygen concentration of $1.3\times10^{18}$ or less, in particular, an MCZ substrate can be used. Namely, by using the Si substrate having a low oxygen concentration, occurrence of abnormal etching can be suppressed and the etching rate can be stabilized. In the manufacturing the ink-jet recording heads according to the present invention, variation in the opening width of the ink supply orifice can be synergistically decreased by using such a Si substrate.

In the above-mentioned description, the ink-jet recording head performs recording by ejecting ink and forming flying droplets, but the present invention is not limited to such a recording head. The present invention can be also applied to liquid ejection head ejecting liquid for preparation of wiring, manufacture of color films, preparation of a DNA chip, or the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structure and functions.

This application claims the benefit of Japanese Application No. 2004-307527 filed Oct. 22, 2004, which is hereby incorporated by reference herein in its entirety.

What is claimed is:

1. A method for manufacturing a liquid ejection head comprising a substrate provided with ejection-energy-generating elements operable to generate energy for ejecting liquid and provided with a liquid supply orifice adapted to supply liquid to the ejection-energy-generating elements, the method comprising:

a step of preparing a silicon (Si) substrate having a first face used to form the ejection-energy-generating elements and a second face;

a step of forming a mask used for forming the liquid supply orifice on the second face of the Si substrate;

a step of forming oxidation-induced stacking faults in the second face of the Si substrate only at a portion in which the periphery of the portion corresponds to an opening of the mask;

a step of forming the ejection-energy-generating elements on the first face of the Si substrate; and a step of forming the liquid supply orifice passing through the substrate by anisotropic etching using the mask.

2. The method for manufacturing the liquid ejection head according to claim 1, wherein the step of forming oxidation-induced stacking faults includes forming the oxidation-induced stacking faults at the portion where the second face is side etched by the anisotropic etching.

3. The method for manufacturing the liquid ejection head according to claim 1, the method further comprising:

a step of mechanically damaging the second face of the Si substrate at a portion and at least the periphery of the portion where the liquid supply orifice is formed, before the step of forming the mask.

4. The method for manufacturing the liquid ejection head according to claim 1, the method further comprising:

a step of damaging the second face of the Si substrate at a portion and at least the periphery of the portion where the liquid supply orifice is formed by dry etching, before the step of forming the mask.

5. The method for manufacturing the liquid ejection head according to claim 1, further comprising:

a step of forming a plurality of the liquid supply orifices in the Si substrate, wherein the second face of the Si substrate has a region where the oxidation- induced stacking faults are not formed between the openings of the mask used for forming the plurality of liquid supply orifices.

6. A method for manufacturing a liquid ejection head comprising a substrate provided with ejection-energy-generating elements operable to generate energy for ejecting liquid and provided with a liquid supply orifice adapted to supply liquid to the ejection-energy-generating elements, the method comprising:

preparing a silicon (Si) substrate having a first face, on which the ejection-energy-generating elements provided, and a second face, on which a mask used for forming the liquid supply orifice provided, wherein the second face is provided with oxidation-induced stacking faults only at a portion in which the periphery of the portion corresponds to the opening of the mask; and forming the liquid supply orifice passing through the substrate by anisotropic etching using the mask.

7. The method for manufacturing the liquid ejection head according to claim 6, wherein the oxidation-induced stacking faults have a length of about 2 μm or more and a density of about $2\times10^4$ stacking faults/$cm^2$ or more.

* * * * *